US007119264B2

(12) United States Patent
Van Dyk

(10) Patent No.: US 7,119,264 B2
(45) Date of Patent: Oct. 10, 2006

(54) MAGNETIC RETURN PEDAL FOR PERCUSSION INSTRUMENTS

(76) Inventor: Michael Van Dyk, 17104 Cabernet CT, Cornelius, NC (US) 28031

( * ) Notice: Subject to any disclaimer, the term of this patent is extended or adjusted under 35 U.S.C. 154(b) by 147 days.

(21) Appl. No.: 10/945,325

(22) Filed: Sep. 20, 2004

(65) Prior Publication Data

US 2006/0060062 A1 Mar. 23, 2006

(51) Int. Cl.
*G10D 13/02* (2006.01)

(52) U.S. Cl. ..... 84/422.1

(58) Field of Classification Search ..... 84/422.1, 84/422.2, 422.3

See application file for complete search history.

(56) References Cited

U.S. PATENT DOCUMENTS 3,797,356 A * 3/1974 Duffy et al. ..... 84/422.1
3,967,523 A * 7/1976 Currier et al. ..... 84/422.1
4,186,644 A * 2/1980 Kurosaki ..... 84/422.1
4,235,146 A * 11/1980 Purdy ..... 84/422.1
4,520,710 A * 6/1985 Elliott, Jr. ..... 84/422.1
4,730,532 A * 3/1988 Bauerfeind ..... 84/422.1
4,819,356 A * 4/1989 Spidell ..... 40/618
4,819,536 A * 4/1989 Lombardi ..... 84/746
4,945,802 A * 8/1990 Ruprecht ..... 84/422.1
4,965,417 A * 10/1990 Massie ..... 200/86.5
6,166,312 A * 12/2000 Brewster et al. ..... 84/422.1
6,590,147 B1 7/2003 Kassabian
6,684,734 B1 * 2/2004 Gatzen ..... 74/560
6,967,272 B1 * 11/2005 Green ..... 84/421
2003/0148853 A1 * 8/2003 Alessandri et al. ..... 482/5

* cited by examiner

*Primary Examiner*—Gary F. Paumen
(74) *Attorney, Agent, or Firm*—Dougherty Clements

(57) ABSTRACT

A musical percussion instrument foot pedal uses a pair of high gauss rated magnets, one under the foot pedal and one on the base below the foot pedal the magnets aligned for magnetic repulsion. The magnetic repulsion between the magnets return the pedal to its original position after having been depressed. An inclined magnet support on the base may allow stacking magnets, raising and lowering the height of the base magnet, or sliding the base magnet into greater and lesser alignment with the pedal magnet.

11 Claims, 5 Drawing Sheets

MAGNETIC RETURN PEDAL FOR PERCUSSION INSTRUMENTS

BACKGROUND OF THE INVENTION

1. Field of the Invention

The present invention relates to percussion instruments and particularly to a musical instrument foot pedal, which uses a pair of magnets, one under the foot pedal and one on the base below the foot pedal, and the magnetic repulsion therebetween to return the pedal to its original position after having been depressed.

2. Description of the Prior Art

The basic drum-kit consists of several drums, most of which are played by means of a stick in each hand, and a bass drum and cymbals and sometimes other percussion instruments which are played by depressing a foot pedal to swing a hammer to strike the drum or other percussion instrument or to pull down one cymbal on top of another to clang them together. The return mechanism on conventional pedals includes a spring, which supplies the force to return the pedal to its original position after having been depressed. The spring in such arrangements have often contributed unwanted metallic noises and interfere in the foot operation while playing.

Prior art U.S. Pat. No. 4,819,536, issued Apr. 11, 1989 to Lombardi, claims a foot-operated, bass drum pedal assembly including: a base in the form of a metal plate, a first drum beater, a support for the beater mounted on the base, and a pedal pivotally mounted to the base and operatively connected to the beater to pivot same as the pedal is pivoted by the drummer's foot, and structure (magnet on the pedal and Hall Effect Sensor on the base) located proximate the pedal to sense downward movement of the pedal to predetermined downward position, and to produce an electrical signal usable to effect production of phenomena corresponding to a drum beat. A single magnet was used on the bass drum foot pedal, but with a sensor on the base, not another magnet, and a spring lifts the pedal after pressing down.

Prior art U.S. Pat. No. 3,967,523, issued Jul. 6, 1976 to Currier, describes a power driven drum beater, which is controlled by means of a foot pedal. The pedal device serves to close an electrical circuit for the actuation of a pivoted solenoid actuated beater mounted on a rod. The foot pedal is further pivotable enabling an electrical contact on the underside thereof to be brought into a desired position along a resistance selector for driving the beater with variable speed or intensity and at a variable rate. The pedal return solenoid is disposed beneath the foot rest and is connected in said electrical circuit means for simulating the rebound or kick-back of a conventional non-electric drum beater.

Prior art U.S. Pat. No. 6,684,734, issued Feb. 3, 2004 to Gatzen, provides a pedal assembly for a bass drum or for high hat cymbals. The pedal assembly has a flat base plate with a resilient pedal board clamped to it, with the pedal board inclined to receive a foot. A beater stick is connected with the toe end of the pedal board by a linkage that drives the beater stick against a bass drum when the pedal is depressed. The resiliency of the pedal board returns it to its normal position when foot pressure is withdrawn. A striker pad limits the depression of the pedal board to limit the force that the beater stick can apply to the drum.

Prior art U.S. Pat. No. 4,186,644, issued Feb. 5, 1980 to Kurosaki, shows a foot pedal assembly for drums, which comprises a rocker cam for holding a beater head and a resilient belt or strap for operationally connecting the rocker cam to an inclined foot pedal are coupled to each other via meshing engagement by cooperating indentations formed on mating surfaces of the two members. Tensile strength of the belt or strap is remarkably enhanced by fortifying members such as steel wires or glass fibers longitudinally embedded in the belt or strap. Stress concentration on a set screw for fixing the belt or strap to the rocker cam can be avoided, permanent strain of the belt or strap after long use is divided into mutually incumulative small fragments and reliable coupling between the belt or strap and the rocker cam assures fair conversion of foot action into beater head movement without undesirable metallic noises.

Prior art U.S. Pat. No. 4,235,146, issued Nov. 25, 1980 to Purdy, claims a bass drum pedal assembly that includes a foot pedal for operating a beater head, the foot pedal including a foot plate which is slidably mounted on a support coupled to the beater head and which is biased towards a rest position. In use, the player depresses the foot pedal and can, at the same time, slide the foot plate forward against its biasing. At the end of a stroke, the pedal returns upwardly and the foot plate is returned to its rest position by said biasing means.

Prior art U.S. Pat. No. 4,945,802, issued Aug. 7, 1990 to Ruprecht, discloses a pneumatic return for foot pedals associated with percussion instruments, such as bass drums and hi-hat stands. The assembly permits adjustable mounting of a drum beater bar, foot pedal and drive chain while providing automatic return of the pedal to a neutral position by means of gas compressed upon depression of the pedal. Gas pressure within the pneumatic return mechanism is also adjustable. There is further optionally provided a substantially identical pneumatic unit for damping the return movement of both the drum pedal and hi-hat stand.

Prior art U.S. Pat. No. 4,520,710, issued Jun. 4, 1985 to Elliott, Jr., indicates two pedal assemblies, for drum and cymbals, mounted together or usable separately. The drum pedal assembly has an inherent escapement mechanism. A drum beater is suspended from a shaft, which is rotated by downward movement of the foot pedal. After rotation to strike a drum, the drum beater returns to its rest position under the action of gravity once the downward force on the pedal is removed. The assembly is designed such that the drum beater counter-balances the foot pedal, decreasing the need for a spring typically employed to provide the escapement or return force. However, for faster return action, a secondary escapement force may be provided by an elastic band suspended between frame posts, which support the shaft. As the drum beater is rotated into the strike position, the elastic band is stretched into a bowed configuration.

Prior art U.S. Pat. No. 6,166,312, issued Dec. 26, 2000 to Brewster, puts forth a pedal operated drum beater device, which comprises a pedal and a drum beater mounted on shaft. The pedal is coupled to shaft by such that depressing the pedal causes the shaft to rotate, advancing the drum beater from a rest position to an operative position. The downward movement of the pedal is opposed by the resilience of elastomeric strip, which stretches and bends as the drum beater moves into the operative position. The device is attached to a drum by drum clamp, formed in two parts, which consist of a drum-mounted rim clamp and a device-mounted, clamp holder. The rim clamp and clamp holder are releasably interlockable through pivotal engagement.

Prior art U.S. Pat. No. 3,797,356, issued Mar. 19, 1974 to Duffy, illustrates a linkage for a foot-operated bass drum pedal in which the conventional leather strip interconnecting the toe end of the pedal and a tranversely mounted shaft carrying means for securing the pivoting end of the drumstick is replaced by a sprocket chain engaging a sprocket on said shaft. Coarse adjustment of the length of the stroke is obtained by shifting the mounting means on the shaft. Fine adjustment is obtained by shifting the end point of the chain with respect to the particular teeth engaged on the sprocket. The last link of the sprocket end of the chain is secured by pintel or cotter keys extended through one of a plurality of transversely extending holes located at the periphery of the socket adjacent the inner end of the teeth thereof. There is also provided a vertically disposed coil spring, the lower end of which has a threaded tensioning means. The contraction of the spring serves to return the pedal to a position of readiness for subsequent operation.

Prior art U.S. Pat. No. 4,965,417, issued Oct. 23, 1990 to Massie, provides a control mechanism adapted for actuation by a human, in the exemplary embodiment by a person's foot. The invention provides for control or actuation of a plurality of devices to be controlled. A plurality of control elements, preferably arranged arcuately with respect to an actuating member is provided with a structure for accurately indexing the actuating member to a particular control element by way of one mode of movement and for actuating an individual indexed control element of a second mode of movement. Particular structure is provided, by way of a foot pedal, in the exemplary embodiment, with particular adjustments so as to adapt the actuating member, that is, the foot pedal, to various sizes and positions of an operator's foot, as well as amplitude of actuating movement.

Prior art U.S. Patent Application No. 20030148853, published Aug. 7, 2003 by Alessandri, describes an apparatus for physical exercise with magnetic interaction between its parts. The physical exercise apparatus for recreational, rehabilitative, gymnastic or sports purposes comprises at least one mobile part and at least one support part, interacting by means of field forces generated by magnetic fields inserted between relative parts of which the apparatus is made.

What is needed is a percussion instrument pedal with a pair of opposing magnets using magnetically opposing force fields to lift the pedal silently and smoothly after depression of the pedal by the foot of the musician.

SUMMARY OF THE INVENTION

An object of the present invention is to provide a percussion instrument pedal with a pair of opposing high powered magnets one the pedal and one the base using magnetically opposing force fields to lift the pedal silently and smoothly after depression of the pedal by the foot of the musician for a return mechanism which operates more smoothly and silently than mechanical means and also will not wear out from use.

Another object of the present invention is to provide a first magnet on the bottom of the foot pedal and a second magnet oriented in polar opposition to the first magnet on a base directly below the first magnet with the base angled upwardly away from the heel of the pedal so that the two magnets are almost in contact at the low point of the depression of the pedal for maximum repulsion between the magnets to cause the pedal to respond instantly in returning to the upright position.

One more object of the present invention is to provide a series of stacked magnets of varying intensity aligned between the bottom of the foot pedal and the base with opposing force fields to create a gradual smooth upward force on the pedal after depression of the pedal by the foot of the musician.

A further object of the present invention is to provide adjustable height magnets in the base to vary the proximity between the base magnets and the pedal magnets and therefore vary the repulsive force between the base magnets and the pedal magnets to change the play of the pedal in terms of resistance in pressing the pedal down and speed of return of the pedal.

A related object of the present invention is to provide slidably adjustable magnets on the base to change the alignment of the base magnets with the pedal magnets and thereby vary the repulsive force between the base magnets and the pedal magnets to change the play of the pedal in terms of resistance in pressing the pedal down and speed of return of the pedal.

In brief, a pair of powerful magnets with a high gauss rating are attached, one on the bottom of the percussion instrument foot pedal and one on the base directly below the foot pedal, the pair of magnets aligned with opposing force fields creating a repulsion between the pair of magnets to force the foot pedal upward after depression by the musician.

An angled magnet mounting platform can be attached to the base below the pedal with the platform angled upwardly away from the heel of the pedal so that the two magnets are almost in contact at the low point of the depression of the pedal for maximum repulsion between the magnets to cause the pedal to respond instantly in returning to the upright position.

In addition, various sizes of stacked magnets may also be mounted in alignment between the bottom of the foot pedal and the base with opposing force fields to create a more gradual smooth upward force on the pedal after depression of the pedal by the foot of the musician.

The repulsive force between the magnets on the bottom of the pedal and the magnets on the base may be varied by adjusting the distance between to two sets of magnets by having a height adjustable base or by offsetting the magnets by having the magnets in the base slidable to align or offset the base magnets with the pedal magnets as desired.

An advantage of the present invention is that it operates smoothly.

A further advantage of the present invention is that the repulsive forces between magnets may be adjusted as desired to change the return speed of the pedal and the resistance in pressing the pedal down.

Another advantage of the present invention is that it operates quietly.

An additional advantage of the present invention is that it may be added to existing drum kits.

One more advantage of the present invention is that it is easy to install.

Yet another advantage of the present invention is that it is inexpensive.

Still another advantage of the present invention is that it will not wear out from use.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
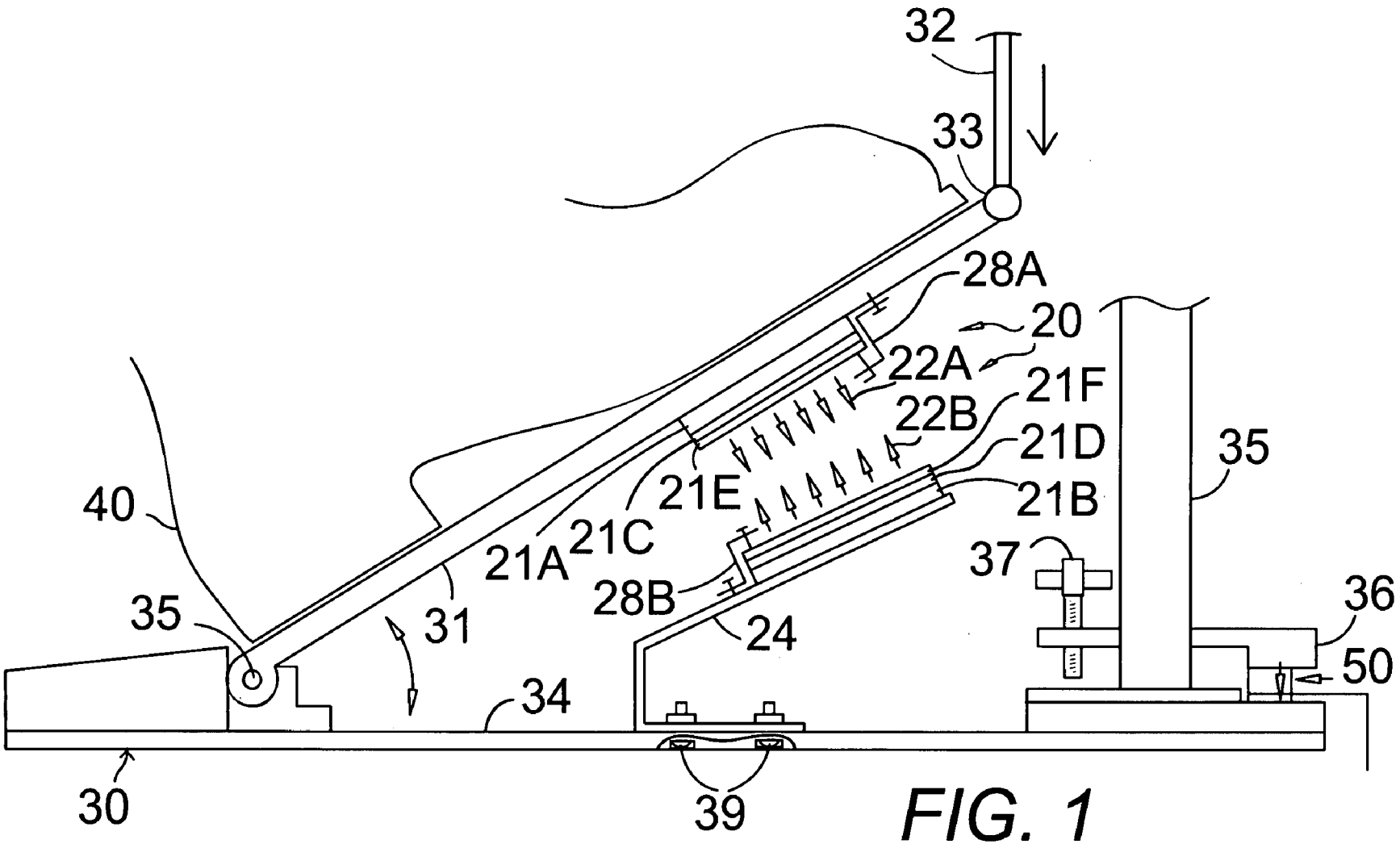
FIG. 1 is a side elevational diagrammatic view of a foot pedal for a musical percussion instrument with the paired high gauss magnets of the present invention, one stacked set of magnets mounted under the pedal and one mating stacked set of magnets on the inclined base in opposing magnetic alignment for magnetic repulsion of the pedal from the base after compressing and releasing the pedal.
Figure 2:
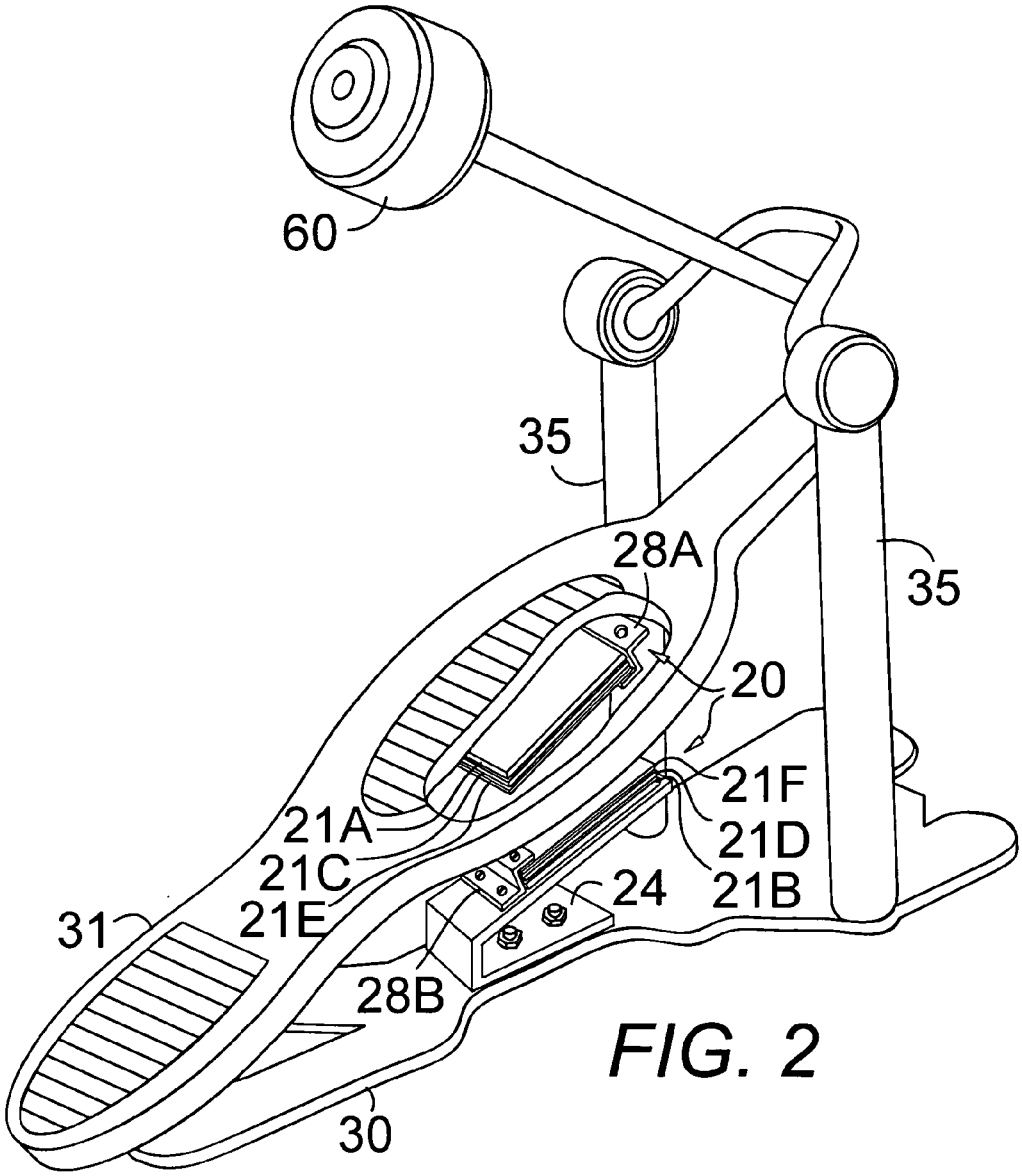
FIG. 2 is a perspective view of the paired high gauss magnets of FIG. 1 mounted on a foot pedal and inclined base of a bass drum pedal.
Figure 3:
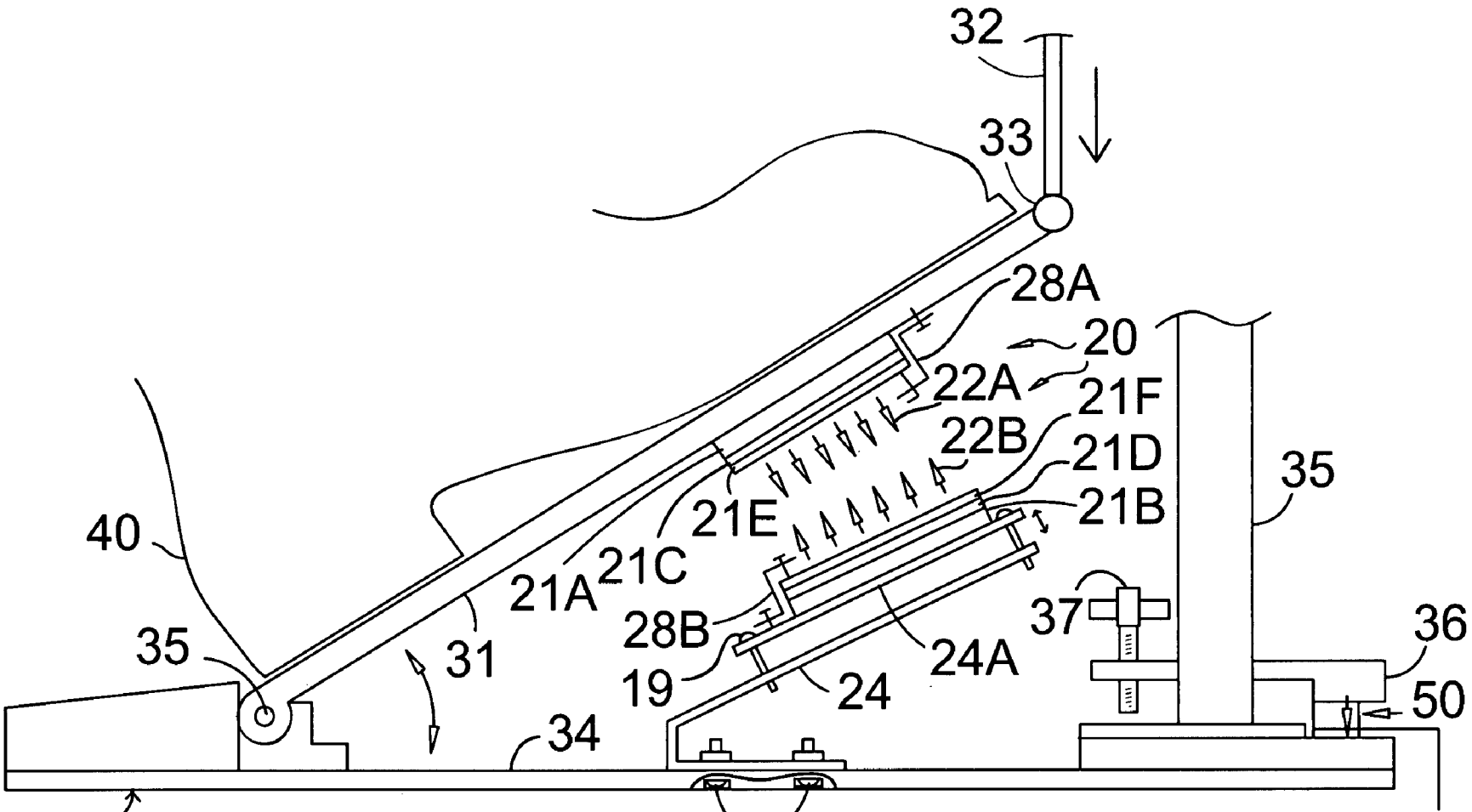
FIG. 3 is a is a side elevational diagrammatic view of a foot pedal for a musical percussion instrument with the paired high gauss magnets of the present invention, one stacked set of magnets mounted under the pedal and one mating stacked set of magnets on a height adjustable inclined base in opposing magnetic alignment for height adjustable intensity magnetic repulsion of the pedal from the base after compressing and releasing the pedal.
Figures 4, 4A:
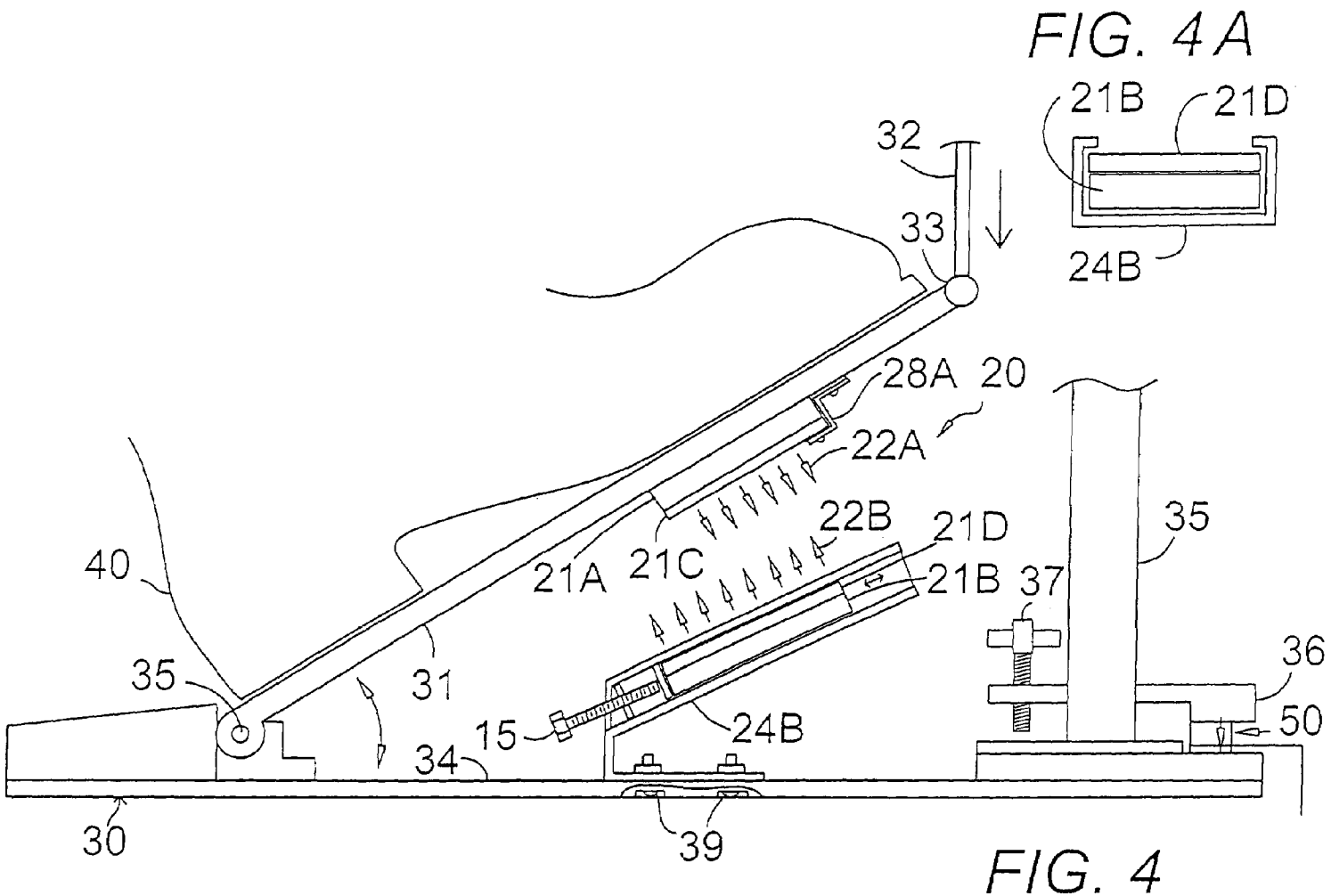
FIG. 4 is a is a side elevational diagrammatic view of a foot pedal for a musical percussion instrument with the paired high gauss magnets of the present invention, one stacked set of magnets mounted under the pedal and one mating stacked set of magnets on a sliding alignment adjustable inclined base within a channel or track in opposing magnetic alignment for alignment adjustable intensity magnetic repulsion of the pedal from the base after compressing and releasing the pedal.
FIG. 4A is an end view of the channel or track of FIG. 4.
Figure 5:
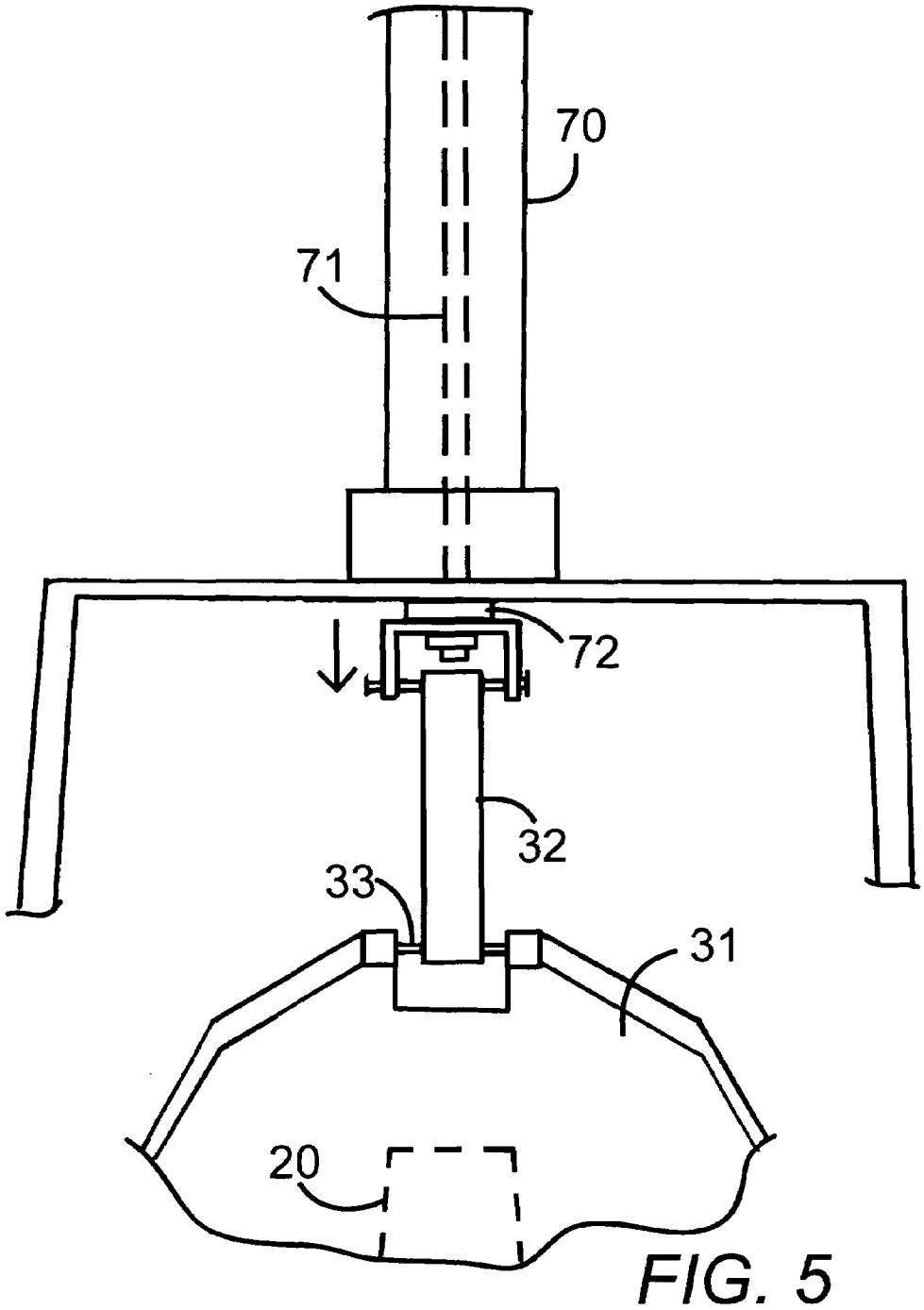
FIG. 5 is a is a partial front perspective diagrammatic view of a foot pedal for a "high hat" cymbal stand showing the vertically movable rod within a cymbal support leg and the pedal mounted one (shown dashed) of the pair of stacked magnets for magnetic repulsion of the pedal from the base after compressing and releasing the pedal.

In FIGS. 1–5, a magnetic return device 20 for a foot pedal mechanism 30 on a musical percussion instrument, such as a bass drum, as shown in FIG. 2, or a "hi hat" cymbal stand, as shown in FIG. 5, comprises at least one pair of high powered magnets 21A and 21B aligned for magnetic repulsion between a pedal 31 mounted to a base 34 by a hinge 35 and an elevated inclined mounting platform 24 on the base 34 for a smooth magnetic force return of the pedal after depressing and releasing the pedal 31.

The device 20 comprises at least one pair of magnets including a first magnet 21A having a high gauss rating, which is adapted to be attached to a bottom of a foot pedal 31 by a bracket 28A or track and a second magnet 21B having a high gauss rating, which is adapted to be attached by a bracket 28B or track to an elevated inclined mounting platform 24 below the foot pedal 31. The second magnet 21B is aligned with the first magnet 21A with a maximum of mutually exposed magnetic surfaces so that the magnetic fields 22A and 22B are in polar repulsion between the magnets 21A and 21B, as shown in FIG. 1, so that after depression and release of the foot pedal 31 by a musician's foot 40, the foot pedal 31 is forced upwardly by the polar repulsion of the magnetic fields 22A and 22B of the magnets 21A and 21B.

The device 20 may further comprise additional pairs of magnets 21C and 21D, 21E and 21F, of lesser gauss rating than the first pair of magnets 21A and 21B, the pairs similarly mounted by stacking onto the high gauss magnets on the pedal 31 and inclined plane 24 on the base 34 for increased mutual magnetic repulsion with a more gradual transition due to the lower gauss magnets to assist in uplifting the pedal after repression of the pedal and smooth out the transition from downward to upward motion of the pedal 31.

The inclined magnet mounting platform 24, shown in FIG. 1, is adapted to be attached by recessed screws 39 and washers or an adhesive to the base 34 below the pedal 31 of a musical percussion instrument with the platform 24 angled upwardly away from the hinge 35 so that the first and the second magnets 21A–21F are almost in contact at a low point of a depression of the pedal 31 for maximum repulsion between the magnetic fields 22A and 22B of the magnets to cause the pedal 31 to respond instantly in returning to an upright position.

In FIG. 3, the inclined magnet mounting platform 24 further comprises a height adjustable inclined magnet mounting plate 24A parallel to the magnet mounting platform 24 by end screws 19 which may be adjusted by elevating the adjustable mounting plate 24A to raise magnet 21B or magnets 21B, 21D, and 21F for closure proximity to the pedal magnet 21A or magnets 21A, 21C, and 21E to increase the magnetically repulsive fields 22A and 22B between the pedal 31 and the inclined magnet mounting platform 24 or to lower the adjustable mounting plate 24A to lower the magnet 21B or magnets 21B, 21D, and 21F for further distance from the pedal magnet 21A or magnets 21A, 21C, and 21F to decrease the magnetically repulsive fields 22A and 22B, thereby providing a height adjustable array of magnets for adjusting the play and speed of movement of the pedal 31.

In FIG. 4, the inclined magnet mounting platform comprises a magnet mounting platform channel 24B or track, as shown in FIG. 4A, to hold the magnet 21B or magnets 21B and 21D in a slidable stacked array which may be adjusted up or down the incline by a long end screw 15 which moves into and out of the channel 24B thereby sliding the magnet 21B or magnets 21B and 21D within the channel 24B putting the base magnet 21B or magnets 21B and 21D in greater or lesser alignment with the pedal magnet 21A or magnets 21A and 21C for more or less mutually exposed surfaces of the magnets to increase or decrease the magnetically repulsive fields 22A and 22B between the pedal and the inclined magnet mounting platform channel 24B, thereby providing a slidable alignment adjustable array of magnets for adjusting the play and speed of movement of the pedal 31.

In FIGS. 1, 3, and 4, the pedal platform 30 and side support column 35 are shown attached to a rim 50 of a bass drum by a clamp 36 adjusted by a hand screw 37.

In FIG. 5 the pedal 31 with the present invention 20 is depressed to pull down the metal bar or strap 32, attached by a pivot 33 to the pedal 31, which lowers the internal rod 71 in the steel tubing post 70 to pull down a top cymbal of a "high hat" cymbal stand onto a lower cymbal with a rubber stop 72 to prevent noise upon return of the metal bar or strap 32 under the force of the mutually repellent fields of the magnets. The internal rod 71 may extend downward from the post 70 and attach by a pivotable means to the pedal 31.

The magnet mounting platform 24 and brackets 28A and 28B or track or channel 24B are preferably formed of a non-magnetic rigid material, such as aluminum or injection molded plastic so they do not interfere with the magnetic repulsion forces 22A and 22B.

In practice, the user depresses a musical instrument foot pedal 31 with a foot 40 to pull down a rigid actuator arm 32 or other actuator attached by a pivot 33 to the pedal 31 which causes the beater 60 (FIG. 2) to hit the drum or a top cymbal (hi hat) to by pulled down by the rod 71 (FIG. 5) to hit the bottom cymbal. At the low point of the depression of the foot pedal 31 the pairs of magnets 21A and 21B (21C and 21D and 21E and 21F) come in close proximity, thereby creating opposing magnetic fields 22A and 22B having magnetic repulsion therebetween, which return the pedal 31 upward to its original position after having been depressed.

It is understood that the preceding description is given merely by way of illustration and not in limitation of the invention and that various modifications may be made thereto without departing from the spirit of the invention as claimed.

What is claimed is:

1. A magnetic return device for a foot pedal on a musical percussion instrument, the device comprising:

a first magnet having a high gauss rating adapted to be attached to a bottom of a foot pedal on a musical percussion instrument;

a second magnet having a high gauss rating adapted to be attached to a base below a foot pedal on a musical percussion instrument pair, the second magnet aligned with the first magnet so that the magnetic fields are in polar repulsion between the magnets so that after depression of a foot pedal by a musician, the foot pedal is forced upwardly by the polar repulsion of the magnetic fields of the magnets.

2. The device of claim 1 further comprising an inclined magnet mounting platform adapted to be attached to a base below a pedal of a musical percussion instrument with the platform angled upwardly away from the heel of the pedal so that the first and the second magnets are almost in contact at a low point of a depression of a pedal for maximum repulsion between the magnets to cause a pedal to respond instantly in returning to an upright position.

3. The device of claim 2 further comprising a height adjustable inclined magnet mounting plate parallel to the magnet mounting platform, the plate attached to the platform by a threaded connector which may be adjusted by elevating the adjustable mounting plate to raise the second magnet for closure proximity to the first magnet and to lower the adjustable mounting plate to lower the second magnet for further distance from the first magnet to increase and decrease the repulsion of the magnetic fields between the first and second magnets.

4. The device of claim 2 wherein the inclined magnet mounting platform comprises a magnet mounting platform track to hold the second magnet slidably within the track and further comprising a means for moving the second magnet slidably within the track to adjust alignment of the second magnet with the first magnet to increase and decrease the repulsion of the magnetic fields between the first and second magnets.

5. The device of claim 2 wherein the magnet mounting platform is formed of a non-magnetically attractive material.

6. The device of claim 5 wherein the magnet mounting platform is formed of aluminum.

7. The device of claim 5 wherein the magnet mounting platform is formed of a molded synthetic.

8. The device of claim 2 wherein a first magnet holding bracket is attachable to a bottom of a pedal for receiving the first magnet in the bracket with a large surface of the first magnet exposed and a second magnet holding bracket is attachable to the angled magnet mounting platform for receiving the second magnet in the second bracket with a large surface of the second magnet exposed.

9. The device of claim 1 further comprising at least one additional pair of magnets of lesser gauss rating than the first magnet and the second magnet mounted with one of the at least one additional pair of magnets stacked on the first magnet and the other of the at least one additional pair of magnets stacked on the second magnet.

10. The device of claim 1 wherein the device is adapted for use with a bass drum foot pedal.

11. The device of claim 1 wherein the device is adapted for use with a "high hat" cymbal stand foot pedal.

* * * * *